United States Patent [19]

Heller

[11] 4,418,682

[45] Dec. 6, 1983

[54] ASPHALT RECLAMATION UNIT

[75] Inventor: Anton H. Heller, Levittown, N.Y.

[73] Assignee: Poweray Infrared Corporation, Amityville, N.Y.

[21] Appl. No.: 268,661

[22] Filed: Jun. 1, 1981

[51] Int. Cl.[3] ..... E01C 19/08

[52] U.S. Cl. ..... 126/343.5 A; 126/391

[58] Field of Search ..... 126/343.5 A, 343.5 R, 126/271.2 C, 391; 366/22-25, 149; 432/13

[56] References Cited

U.S. PATENT DOCUMENTS

| | | | |
|---|---|---|---|
| 950,413 | 2/1910 | Stedman et al. | 126/343.5 R |
| 2,496,113 | 1/1950 | Wollner | 126/391 |
| 3,315,659 | 4/1967 | Schmitz | 126/343.5 A |
| 3,386,435 | 6/1968 | Heller | 126/343.5 A |
| 3,503,382 | 3/1970 | Wollner | 126/343.5 A |
| 3,577,976 | 5/1971 | Heller | 126/343.5 A |
| 4,192,288 | 3/1980 | Heller | 126/343.5 A |

FOREIGN PATENT DOCUMENTS

| | | | |
|---|---|---|---|
| 250125 | 4/1926 | United Kingdom | 126/343.5 A |
| 407049 | 3/1934 | United Kingdom | 126/343.5 A |
| 567778 | 8/1977 | U.S.S.R. | 126/343.5 A |
| 668995 | 6/1979 | U.S.S.R. | 366/25 |

*Primary Examiner*—Samuel Scott

*Assistant Examiner*—Margaret A. Focarino

*Attorney, Agent, or Firm*—Cooper, Dunham, Clark, Griffin & Moran

[57] ABSTRACT

A unit for heating initially solid asphaltic material to provide asphaltic concrete in a condition suitable for application, including an inner enclosure defining a volume for containing the material to be heated, an outer enclosure surrounding and spaced from the inner enclosure to define a space beneath the inner enclosure and passages for air flow around the walls of the inner enclosure, infrared energy sources within the latter space for heating air, heating chambers projecting upwardly from the floor of the inner enclosure above the infrared sources to provide regions through which hot air rises from the sources, and flues extending transversely from the upper portions of the heating chamber to the side walls of the inner enclosure for conducting the heated air from the heating chambers to the aforementioned passages. Heat-shielding means are interposed between the infrared sources and adjacent portions of the inner enclosure to prevent local overheating of the material. The unit is operated to heat the initially cold material to a temperature between 275° and 300° F. and to maintain it at that temperature until it is used.

8 Claims, 3 Drawing Figures

Fig. 1.
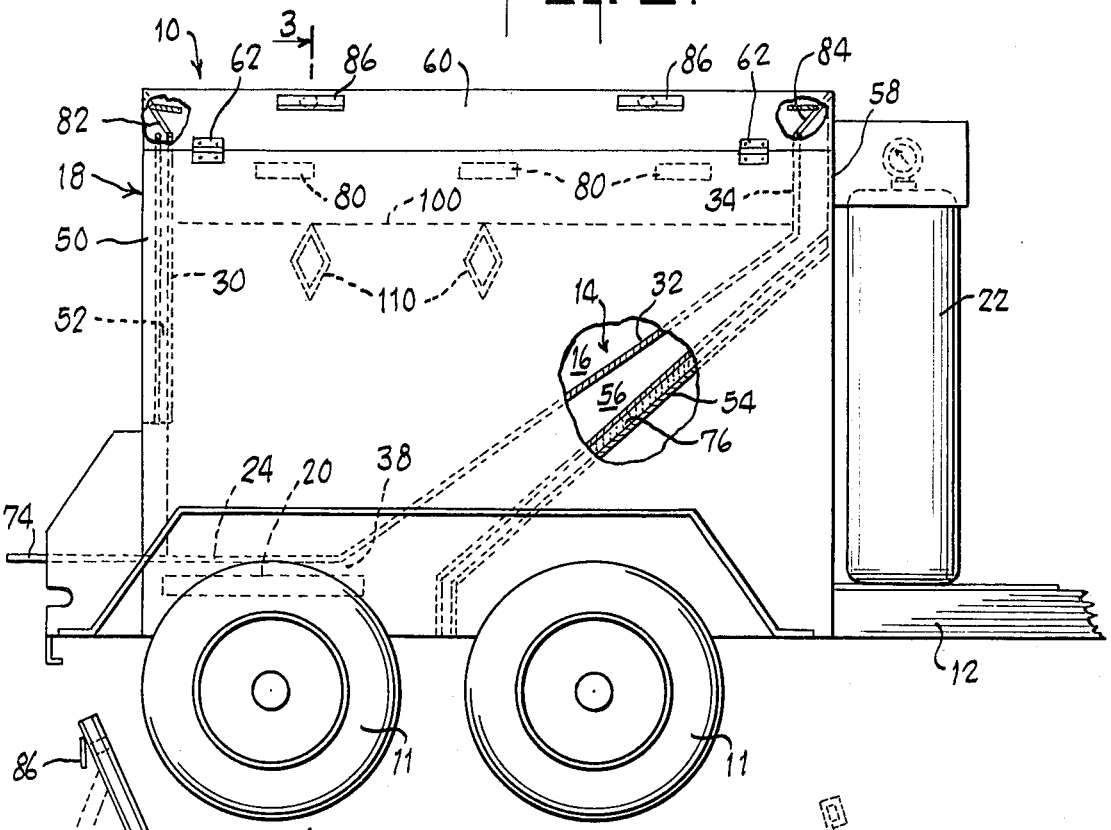
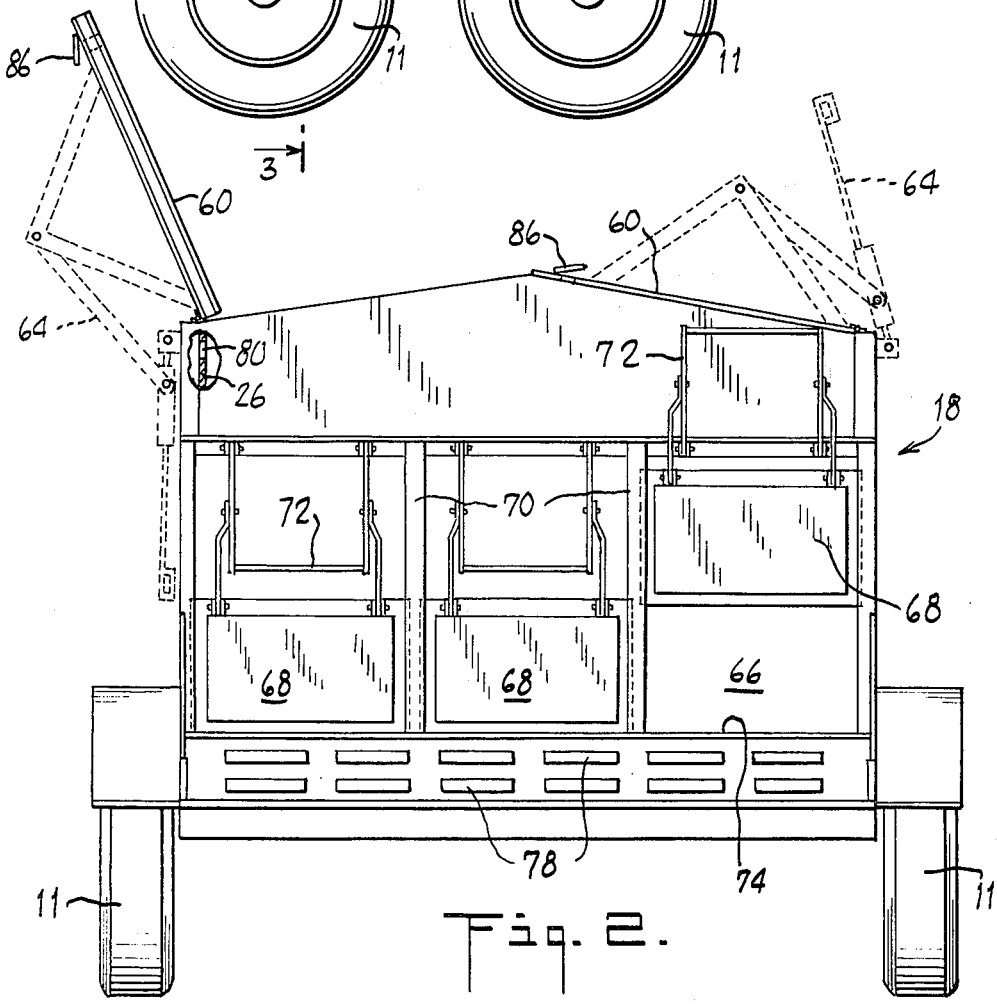
Fig. 2.

ASPHALT RECLAMATION UNIT

BACKGROUND OF THE INVENTION

This invention relates to the provision of asphaltic concrete in a state or condition suitable for paving application or the like, and particularly to the production of asphaltic concrete in such condition for application from initially solid asphaltic material. In a specific sense, the invention is directed to an asphalt reclamation unit for this purpose.

It is known to heat chunks or other pieces of initially solid, cold asphaltic material (i.e. asphaltic material initially at ambient atmospheric temperature) to provide asphaltic concrete for paving or like application, e.g. for patching. For example, useful asphaltic concrete can be reclaimed in this way from chunks of used asphaltic concrete paving. Desirably, the produced material should be a substantially homogeneous, soft or flowable mass capable of being spread easily and evenly to constitute a patch.

Heretofore, procedures for reclaiming used asphaltic material have involved rapid heating. Difficulties associated with such prior practice have included excessive heating of the material, oxidation of the liquid component thereof, segregation of components, and/or burning. These disadantages have led to nonhomogeneous or otherwise defective products.

Applicant's prior U.S. Pat. Nos. 3,386,435 and 3,577,976 describe units for storing materials such as asphalt at an elevated temperature. In these units, the asphalt is contained within an inner enclosure which is surrounded by an outer enclosure that defines spaces or passages beneath and on all sides of the inner enclosure. Air, heated by an infrared energy source beneath the inner enclosure, flows through these spaces and/or passages to minimize the thermal gradient across the wall of the inner enclosure and thereby to retard heat loss from the contained hot asphalt; the rising heated air is introduced to the top of the inner enclosure through plural horizontally spaced apertures arranged to provide a flow of heated air across the top of the contained asphalt, for further minimizing the heat loss. As will be understood from the cited patents, the purpose of these structures is primarily to maintain the elevated temperature of a charge of asphaltic material supplied to the inner enclosure in initially heated condition, and not to heat an initially cold charge to a suitable temperature for application.

U.S. Pat. No. 2,496,113 describes a heater for melting bituminous material wherein heated gas is passed through an essentially horizontal flue system extending within or beneath the charge of material to be heated and is then conducted upwardly at one end of the heater so as to be directed across the surface of the charge. Neither in applicant's prior patents nor in aforementioned U.S. Pat. No. 2,496,113 is there disclosed any provision of passages for conducting heated air or gas upwardly through the body of the charge.

SUMMARY OF THE INVENTION

It is now found that asphaltic concrete in suitable condition for paving application or the like can be provided from initially cold asphaltic material by heating the material, relatively slowly, to a temperature between about 275° and about 300° F. and maintaining it at that temperature until it is used. Such heating operation avoids overheating, segregation, oxidation, or ignition of components of the asphaltic material, and provides a very satisfactory product.

The present invention contemplates the provision of an asphalt reclamation unit for performing this heating procedure. The unit includes an upwardly open inner enclosure defining a volume for containing asphaltic material to be heated, and having a floor, end walls, and side walls; and an outer enclosure surrounding the inner enclosure and having a floor, end walls, and side walls respectively disposed in adjacent spaced relation to the floor, end walls, and side walls of the inner enclosure to define a gas space between the inner and outer enclosure floors, and end and side wall gas passages between the inner enclosure walls and the outer enclosure walls respectively adjacent thereto. The outer enclosure also has door means for closing the top of the unit. The gas space communicates with the outside atmosphere, the passages communicate with the gas space and with the uppermost portion of the aforementioned volume, and the upper portion of that volume is vented to the outside atmosphere, for enabling continuous air flow into the gas space and thence through the passages and the upper portion of the volume. Additionally, the unit has at least one source of infrared energy, disposed in the gas space, for heating air entering the gas space from the outside atmosphere.

As a particular feature of the invention, the unit includes at least one heating chamber projecting upwardly from the floor of the inner enclosure into an upper portion of the aforementioned volume at a locality intermediate and spaced from the side walls of the inner enclosure, the heating chamber comprising thermally conductive wall portions defining a gas flow region isolated by the wall portions from the volume and opening into and extending upwardly from the gas space above the one infrared energy source; and flue means for conducting heated air from an upper locality in the gas flow region transversely across the upper portion of the volume to the side wall passages, such that air heated by this source flows upwardly through the gas flow region and thence through the flue means to the side wall passages. Preferably, the unit has a plurality (at least two) of such heating chambers, extending from end to end of the inner enclosure in spaced relation to each other, with a separate infrared energy source disposed beneath each heating chamber. Preferably, also, the flue means comprises at least two transverse flues, extending between the side walls of the inner enclosure in horizontally spaced relation to each other, and each communicating with each of the heating chambers. As an additional particular feature of the invention, heat-shielding means are interposed between each infrared energy source and the inner enclosure, for preventing local overheating of portions of the asphaltic material charge adjacent that source.

Further features and advantages of the invention will be apparent from the detailed description hereinbelow set forth, together with the accompanying drawing.

BRIEF DESCRIPTION OF THE DRAWINGS

FIG. 1 is a side elevational view, partly broken away, of an illustrative embodiment of the apparatus of the invention;

FIG. 2 is a rear elevational view of the same apparatus; and

DETAILED DESCRIPTION

Figure 3:
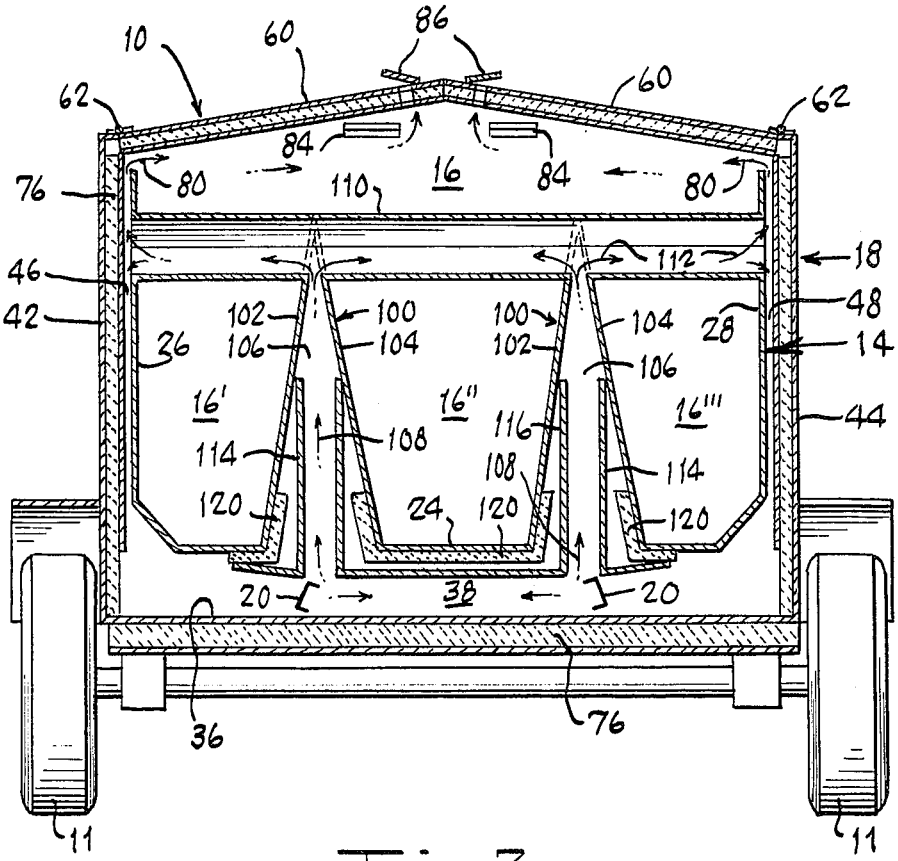
FIG. 3 is a sectional elevational view taken along the line 3—3 of FIG. 1.

Referring to the drawings, there is shown an asphalt reclamation unit 10 embodying the invention in a particular form, supported on wheels 11 and having a forwardly extending frame 12 with a front end (not shown) designed to be coupled to a vehicle such as a truck, tractor, or the like so that the unit can be drawn as a trailer. A conventional device (also not shown) is provided at the front end of the frame for supporting the unit in stationary, level position when unhitched from the towing vehicle.

The unit 10 broadly comprises an upwardly open inner enclousre 14 defining a volume 16 containing a quantity of initially solid asphaltic material (not shown), e.g. lumps or other pieces of used asphalt pavement supplied to the volume 16 at ambient atmospheric temperature; an outer enclosure 18 essentially completely surrounding the inner enclosure in outwardly spaced relation thereto; and means 20 for heating the contained asphaltic material to produce asphaltic concrete in a state suitable for paving application. A pair of propane gas tanks 22 (one being shown) are removably secured side by side on the frame 12 ahead of the outer enclosure 18 to supply fuel to the heating means, which, in the illustrated embodiment, comprises so-called infrared energy converters constituting horizontally elongated sources of infrared energy incorporating burners fueled by the propane gas from the tanks.

The inner enclosure 14 includes a generally flat horizontal bottom wall or floor 24, a pair of opposed flat vertical side walls 26 and 28 joined to (and respectively rising from opposite sides of) the floor 24, a vertical rear end wall 30, and a front end wall 32 which slopes forwardly and upwardly from the floor 24 for most of the height of the enclosure 14 and terminates in a short vertical upper portion 34. The floor and walls of the enclosure 14 are fabricated of a thermally conductive metal to facilitate heating of the contained asphaltic material (which is in direct contact with the interior surfaces of the floor and walls) by heated gas, i.e. air, circulating past the exterior surfaces of the floor and walls as hereinafter further described.

The outer enclosure 18 has a generally flat horizontal bottom wall or floor 36 spaced below the inner enclosure floor 24 to define a gas space 38 therebetween, extending beneath the full width of the floor 24 and containing the infrared energy converters 20. In addition, the enclosure 18 includes opposed side walls 42 and 44 rising vertically from the floor 36 in outwardly spaced relation to the inner enclosure side walls 26 and 28 to define therewith side gas passages 46 and 48; a vertical rear end wall 50 extending between the side walls 42 and 44 and spaced outwardly of the wall 30 to define therewith a rear end gas passage 52 communicating laterally with passages 46 and 48; and a front end wall 54 sloping forwardly and upwardly from the floor 36 in outwardly spaced relation to the wall 32 to define therewith a front end gas passage 56, which at its lower end communicates directly with the gas space 38, and also communicates laterally with the passages 46 and 48. As shown, the slope of the wall 54 is steeper than that of the wall 32, so that the passage 56 narrows progressively in an upward direction. The uppermost portion 58 of the wall 54 is vertical, and defines with wall portion 34 the upper extremity of passage 56.

At its top, the outer enclosure 18 is provided with movable lid means comprising a pair of loading doors 60 respectively secured by hinges 62 to the top edge portions of the side walls 42 and 44 and cooperatively constituting a peaked roof for the unit 10. The loading doors, when shut, cover and complete the enclosure of the volume 16; they are opened by pivotally mounted, manually operable handle structures 64 to enable the volume 16 to be filled with asphaltic material to be heated. Three openings 66, formed in the inner and outer rear end walls 30 and 50 and disposed side by side in the lower portion of the rear of the unit 10, are respectively closed by three doors 68 which slide vertically in tracks 70 and are opened by pivotally mounted handle structures 72 for removal of produced asphaltic concrete from the volume 16 through the openings 66. An extension 74 of the inner enclosure floor 24, projecting rearwardly beyond the openings 66, serves as a shoveling platform to facilitate such removal of the asphaltic concrete product.

The floor, walls, and loading doors of the outer enclosure 18 are preferably all of double construction, viz. constituted of spaced plates with thermal insulation 76 filling the gap between the plates, to minimize heat loss from the interior of the unit 10. Although generally spaced from the surrounding enclosure 18 to provide the aforementioned gas space and passages, the inner enclosure 14 is fixedly mounted within and secured to the enclosure 18 by suitable support structure (not shown).

The gas space 38 communicates with the external atmosphere, for example through louvered slits 78 formed in a portion of the outer rear end wall 50 below the inner enclosure floor 24, for supply of air to the gas space. As hereinafter further explained, air heated within the gas space by the infrared converters or sources 20 rises through the gas passages between the inner and outer enclosure walls, contributing to the desired heating of the asphaltic material within the volume 16 as well as minimizing the thermal gradient across the walls of the inner enclosure 14 to retard heat loss from the contained material when the latter material is heated. The gas passages communicate with the volume 16 through horizontally elongated apertures spaced around the uppermost portion of the walls of the inner enclosure; specifically, each side wall 26 and 28 of the inner enclosure has a plurality of apertures 80 spaced along its length, while louvered apertures 82 and 84 are provided in the rear and front end walls respectively, at a level somewhat higher than that of the apertures 80. Each of the loading doors 60 has a pair of louvered vents 86 spaced along its length adjacent the peak of the roof cooperatively formed by the doors, for discharging gas to the atmosphere from the volume 16. The apertures 80, 82 and 84 and the vents 86 are so arranged that heated gas (air) rising through the wall passages 46, 48, 52 and 56 flows therefrom through the apertures into the volume 16 and across the upper surface of the body of asphaltic material contained therein, further contributing to the heating of that material, before exiting from the unit 10 to the atmosphere through the vents 86.

The structure of the unit 10 as thus far set forth corresponds generally to features of construction and arrangement shown in one or more of applicant's aforementioned U.S. Pat. Nos. 3,386,435 and 3,577,976, the disclosures of which are incorporated herein by this reference. Particular features of the present invention, for effecting the heating of initially solid and "cold"

(ambient-temperature) asphaltic material to produce asphaltic concrete, will now be described.

In accordance with the invention, then, the unit 10 further includes a plurality of heating chambers 100, projecting upwardly from the inner enclosure floor 24 to the upper portion of the volume 16 (but terminating below the uppermost portion of the inner enclosure 14) and extending from end to end of the inner enclosure in laterally spaced, parallel relation to each other so as to divide the volume 16 lengthwise into plural parallel subvolumes opening upwardly into a common space through which the gas flow from the apertures 80, 82 and 84 circulates. Two such heating chambers 100 are shown in the illustrated embodiment of the invention, dividing the volume 16 into three relatively narrow subvolumes 16′, 16″, and 16‴ each extending lengthwise of the unit 10 and respectively in register with the three openings 66 at the rear of the unit. As will now be appreciated, the provision of three openings 66 facilitates removal of asphaltic concrete from these three subvolumes.

Each of the heating chambers 100 is formed by two walls 102 and 104 which constitute part of the wall structure of the inner enclosure 14 and are fabricated (like the remainder of the inner enclosure) of a thermally conductive metal. These walls converge upwardly so that the heating chamber they cooperatively constitute has an inverted V shape as seen in transverse section (FIG. 3). The walls 102 and 104 of each heating chamber define, between them, a gas flow region 106 which opens downwardly through the inner enclosure floor 24 into the gas space 38 from the rear end wall 30 to the front end wall 32 of the inner enclosure; these walls 102 and 104 are joined to the front and rear walls 30 and 32 and to the floor 24 to isolate the region 106 from the volume 16. It will be appreciated that asphaltic material within the volume 16 is in contact with the walls 102 and 104 of the two heating chambers 100. The unit 10 has two of the infrared energy converters 20, e.g. mounted on a movable tray (not shown), and respectively disposed in the gas space 38 directly beneath the gas flow regions of the two heating chambers 100, in alignment with the long dimensions of the heating chambers, so that gas (i.e. air) heated by the converters rises from the gas space 38 directly into the gas flow regions of the heating chambers, as indicated by arrows 108. The heated gas also rises from the gas space 38 directly into the end passage 56, into the side wall passages 46 and 48.

Further in accordance with the invention, transverse flues 110 (also fabricated of a thermally conductive metal) extend across the interior of the inner enclosure 14, at an upper level therein, for interconnecting the uppermost portions of the gas flow regions 106 of the heating chambers 100 with the side wall passages 46 and 48. Two of these flues 110 are provided in the unit 10, at locations spaced along the length of the unit. Heated air rising through the regions 106 is conducted by the flues 110 to the side wall passages (as indicated by arrows 112), where it circulates and finally enters the upper portions of the volume 16 through the apertures 80. In this way, a continuous upward flow of heated air is maintained in the heating chamber regions 106 as well as through the wall passages, and the heated air enters the volume 16 only through the apertures at the top of the walls.

As a still further feature of the invention, heat-shielding means are interposed between the converters 20 and the portions of the inner enclosure structure (i.e. the portions of floor 24 and of heating chamber walls 102 and 104) adjacent the converters, to prevent localized overheating of the material within the volume 16 and thereby to contribute to desired uniformity of heating. In the embodiment illustrated, this shielding means includes deflector plates 114 and 116 disposed externally of the lower portions of the walls 102 and 104 (i.e. on the side of those walls external to the volume 16) and extending around the adjacent portions of the floor 24. The deflector plates are joined to the inner enclosure structure along their edges but are otherwise spaced therefrom so as to define dead air or dampener spaces 118. Additionally, the shielding means includes layers of thermal insulation 120 mounted within the spaces 118 on those portions of the external surfaces of the inner enclosure wall structure which are closest to the converters 20. The shielding means prevents heated air in the immediate vicinity of the converters (i.e. that air which is at the highest temperature) from coming into direct contact with the thermally conductive walls of the inner enclosure.

The use of the described unit to prepare asphaltic concrete may now be readily understood. The volume 16 is filled with chunks or other pieces of initially solid asphaltic material at ambient atmospheric temperature; these chunks, for example, may be broken up pieces of asphaltic pavement or other suitable starting material for the production of asphaltic concrete. The burners of the converter 20, fueled by propane gas from one of the tanks 22, are turned on and operated, preferably under control of a suitable and e.g. generally conventional thermostat system (not shown). Air entering the gas space 38 is heated by the infrared energy produced by the converters. The heated air rises from the converters through the regions 106 of the heating chambers 100 and through the forward gas passage 56, with a flow velocity enhanced by the upward taper of that passage and of the heating chamber regions. From the upper portions of the heating chamber regions the heated air flows laterally through the flues 110, thence through the side wall passages 46 and 48, rising to the apertures 80, 82 and 84 in the side and end wall passages, and finally enters the upper portion of the volume 16 where it flows across the top surface of the asphaltic material being heated before leaving the unit through the vents 86.

The converters 20, conveniently under thermostatic control as aforesaid, are operated to achieve and maintain a temperature between 275° F. and 300° F. throughout the body of asphaltic material in the volume 16. This heating is accomplished in the described unit with advantageous effectiveness and uniformity of temperature, since the charge of asphaltic material is subdivided or penetrated by the heating chambers 100 with their regions 106 of upwardly flowing heated air, as well as being surrounded by flows of heated air (in the subjacent gas space 38, the wall passages, and the upper portion of volume 16), and since the heat-shielding means prevents local overheating of the portions of the charge nearest the converters. The slow, uniform heating of the material to a temperature in the 275°–300° F. range, afforded by the present unit, produces (from an initially cold charge) asphaltic concrete in a suitable state or condition for use within a reasonable period of time, and avoids such problems of prior practice as excessive heating, burning, oxidizing, and/or segregating components of the asphaltic concrete. Moreover, the unit readily enables maintenance of the asphaltic concrete within the stated temperature range until the material is used. Thus, for example, a unit of the described construction having a 4-ton capacity and two 50,000 B.T.U. infrared-type converters may be charged with cold material at the end of a working day, and operated overnight (for a period of, say, 12 to 14 hours) to heat the material; by the next morning, the asphaltic concrete will be at the desired temperature and ready for use, and will be maintained at that temperature by the unit.

The transverse flues 110, providing paths at the top of the heating chamber regions 106 for outflow of heated air rising through the latter regions, assure continuous directional flow of heated air upwardly through the regions 106 as well as constituting, in themselves, additional heated air passages extending through the volume 16, and therefore contribute to the even and efficient heating of the asphaltic concrete charge. In the particular unit described, the provision of two heating chambers 100 and two transverse flues 110 affords effective heating of a full day's supply of asphaltic concrete for patching purposes or the like in a structure conveniently dimensioned for transport as a vehicular trailer. The slope of the heating chamber walls 102 and 104 and the front end wall 32 in this unit facilitates withdrawal of asphaltic concrete from the interior of the unit through the openings 66.

It is to be understood that the invention is not limited to the features and embodiments hereinabove specifically set forth, but may be carried out in other ways without departure from its spirit.

I claim:

1. An asphalt reclamation unit for heating initially solid asphaltic material from ambient atmospheric temperature to an elevated temperature between about 275° F. and about 300° F. and thereafter maintaining the material at the elevated temperature to provide asphaltic concrete in a condition suitable for paving application or the like, comprising:

(a) an upwardly open inner enclosure defining a volume for containing asphaltic material to be heated, and including a floor, end walls, and side walls;

(b) an outer enclosure surrounding said inner enclosure and including a floor, end walls, and side walls respectively disposed in adjacent spaced relation to the floor, end walls, and side walls of said inner enclosure to define a gas space between the inner and outer enclosure floors and end and side wall gas passages between the inner enclosure walls and the outer enclosure walls respectively adjacent thereto, said outer enclosure further including door means for closing the top of the unit, said gas space communicating with the outside atmosphere, said passages communicating with said gas space and with the uppermost portion of said volume, and said upper portion of said volume being vented to the outside atmosphere, for enabling continuous air flow into said gas space and thence through said passages and said upper portion of said volume;

(c) at least one source of infrared energy disposed in said gas space for heating air entering said gas space from the outside atmosphere;

(d) heating chamber means comprising at least one heating chamber projecting upwardly from the floor of the inner enclosure into an upper portion of said volume at a locality intermediate and spaced from the side walls of said inner enclosure, said one heating chamber extending from end to end of said inner enclosure and comprising thermally conductive wall portions of said inner enclosure defining a gas flow region isolated by the wall portions from said volume and opening into and extending upwardly from said gas space above said one infrared energy source; and (e) flue means, comprising at least one flue extending from side to side of said inner enclosure and spaced away from both ends thereof, for conducting heated air from the uppermost portion of said gas flow region transversely across said upper portion of said volume to said side wall passages, such that air heated by said source flows upwardly through said gas flow region and thence through said flue means to the side wall passages;

(f) said walls of said inner enclosure, said heating chamber means, and said flue means being mutually disposed to enable delivery of solid pieces of the asphaltic material downwardly from the top of the unit into the lowermost portion of said volume.

2. A unit as defined in claim 1, wherein said heating chamber means comprises a plurality of heating chambers projecting upwardly from the inner enclosure floor into said volume in spaced relation to each other, each of said heating chambers extending from end to end of said inner enclosure and comprising thermally conductive wall portions of said inner enclosure defining a gas flow region as aforesaid, and including a corresponding plurality of sources of infrared energy respectively disposed beneath the gas flow regions of the heating chambers, said flue means comprising means for conducting heated air from the uppermost portion of each of the gas flow regions to the side wall passages as aforesaid.

3. A unit as defined in claim 2, wherein said flue means comprises a plurality of flues extending from side wall to side wall of said inner enclosure in horizontally spaced relation to each other, each of said flues communicating with each said gas flow region.

4. A unit as defined in claim 3, wherein there are two heating chambers and two flues.

5. A unit as defined in claim 1 or 2, further including heat-shielding means interposed between said inner enclosure and each said infrared energy source for preventing local overheating of asphaltic material contained in portions of said volume adjacent each said source.

6. A unit as defined in claim 5, wherein said shielding means comprises plates joined at their edges to external surfaces of said wall portions and said inner enclosure floor for defining therewith air spaces adjacent each said source.

7. A unit as defined in claim 6, wherein said shielding means further includes bodies of thermally insulated material mounted on said last-mentioned external surfaces within said last-mentioned air spaces.

8. A unit as defined in claim 3, wherein the thermally conductive wall portions of said heating chambers converge upwardly.

* * * * *